US006612711B1

(12) United States Patent
Hagenbach et al.

(10) Patent No.: US 6,612,711 B1
(45) Date of Patent: Sep. 2, 2003

(54) LIGHTING DEVICE

(75) Inventors: Uwe Hagenbach, Eichenried (DE); Bernhard Grill, Seeshaupt (DE); Manfred Amling, Ering (DE)

(73) Assignee: Licht-Technik Vertriebs GmbH, Munich (DE)

( * ) Notice: Subject to any disclaimer, the term of this patent is extended or adjusted under 35 U.S.C. 154(b) by 0 days.

(21) Appl. No.: 09/787,245

(22) PCT Filed: Sep. 15, 1999

(86) PCT No.: PCT/EP99/06828

§ 371 (c)(1),
(2), (4) Date: Jul. 25, 2001

(87) PCT Pub. No.: WO00/16005

PCT Pub. Date: Mar. 23, 2000

(30) Foreign Application Priority Data

Sep. 15, 1998 (DE) ..... 298 16 562 U

(51) Int. Cl.[7] ..... F21V 33/00

(52) U.S. Cl. ..... 362/96; 362/450; 362/352; 362/189; 362/253

(58) Field of Search ..... 362/96, 450, 352, 362/363, 189, 253; 446/220, 222, 223, 224, 226

(56) References Cited

U.S. PATENT DOCUMENTS

| | | | | | |
|---|---|---|---|---|---|
| 3,935,658 | A | * | 2/1976 | Simpson | 362/363 |
| 4,292,999 | A | * | 10/1981 | Szollmann | 362/96 |
| 4,542,445 | A | * | 9/1985 | Marletta | 362/96 |
| 4,737,133 | A | * | 4/1988 | Neumeier | 446/222 |
| 5,083,250 | A | * | 1/1992 | Malcolm | 362/253 |
| 5,117,344 | A | * | 5/1992 | Perez | 362/352 |
| 5,295,891 | A | * | 3/1994 | Schalk | 446/222 |
| 5,683,167 | A | * | 11/1997 | Tarlow | 362/96 |

FOREIGN PATENT DOCUMENTS

| | | |
|---|---|---|
| DE | 89 05 690 | 9/1989 |
| DE | 195 29 648 | 3/1997 |
| DE | 298 16 562 | 3/1999 |
| EP | 0 295 089 | 12/1988 |
| GB | 2 260 394 | 4/1993 |

* cited by examiner

*Primary Examiner*—Thomas M. Sember
(74) *Attorney, Agent, or Firm*—Knobbe Martens Olson & Bear LLP

(57) ABSTRACT

A lighting device includes a spotlight and an inflatable sack detachably connected thereto and made of a material that is at least partially light-transmitting. The sack has a transparent light entrance orifice to couple to a light exit orifice of the spotlight. The light entrance orifice of the inflatable sack is defined by a transparent glass disk or a transparent foil, which along a circumferential edge is connected in an airtight manner to an edge of a corresponding orifice in the sack.

18 Claims, 3 Drawing Sheets

LIGHTING DEVICE

FIELD OF THE INVENTION

The present invention relates to a lighting device, in particular a lighting device for stage presentations and cinematography.

BACKGROUND OF THE INVENTION

Lighting devices for theatrical and cinematic illumination must meet a variety of demands. In addition to being rapidly installable and removable, they should enable alternative light and colour effects to be achieved in frequent and quick succession, with various intensities. To avoid disturbing noises, in particular during filming with an original sound track, they should also operate as quietly as possible. Furthermore, they should provide the softest possible light.

SUMMARY OF THE INVENTION

The objective of the present invention is to provide a lighting device with which the preceding requirements can be fulfilled—that is, one that is easily and reliably manipulated and that can be used in combination with lights that are already available, such as stage spotlights, which reduces expense. This objective is achieved with the present invention.

The central point of the present invention is to provide a spotlight or similar lighting object with an inflatable sack through which the light passes outward, such that the emerging light is extremely soft and illuminates the surrounding space uniformly. In a first embodiment the sack, which is made of at least partially light-transmitting material, comprises a transparent light-entrance orifice by way of which it can be attached to a light-exit orifice of the spotlight. The light-entrance orifice of the inflatable sack is preferably defined by a transparent foil connected around its circumferential edge, in an airtight manner, to the edge of a corresponding opening in the sack.

When the sack is closed on all sides in an airtight manner, it must be provided with a valve through which the sack can be inflated or, after use, can be deflated.

A second embodiment is characterized in that the sack is open at its light-entrance side, so that it can be inflated through the relevant opening by means of an external blower, which is preferably associated with the spotlight.

Particular mention should be made of the construction of the "light sack", which is such that in the inflated state it has substantially the shape of a cylindrical rod, a sphere, a hemisphere, a cone or a truncated cone. When it is constructed in the shape of a cylinder its length can be from 1 to 10 m. The diameter is approximately 0.30 to 0.60 m.

Preferably the material of which the sack is made is air-permeable plastic film, which can be reinforced with textile.

It is also advantageous for the interior of the sack to be provided at least partially, in particular at its end face, with a light-reflecting zone, so as to produce a kind of luminous rod from which a soft light emerges radially.

Finally, it is of special significance for the blower used to inflate the sack, in particular the air outlet of the blower which opens into the sack, to be provided with a nonreturn valve, in particular a valve in which elastic tension is exerted in the closing direction, so as to prevent the escape of air from the sack after the blower has been turned off. This embodiment is particularly important when original-sound recording is intended.

Regarding the material for the "light sack" it should also be mentioned that sailcloth, in particular spinnaker cloth is suitable, because it provides both the desired light transmittance and the required stability. This material is not absolutely impermeable to air. Therefore when it is used, care should be taken to keep the blower continually in pressure-dependent operation, or to reactivate it whenever the pressure inside the sack falls below a predetermined level. However, as stated above, material that is not permeable to air is particularly suitable for the "air sack", preferably textile-reinforced plastic film.

The terms "airtight" and "impermeable to air" should be understood to refer to a material with a property such that a sack of which it is made can be inflated and will then remain in the inflated state for a certain period of time, in particular ca. 15–60 minutes, with no further addition of air or another gas—that is, for example, after a blower has been turned off. This feature makes the lighting device in accordance with the invention particularly suitable for original-soundtrack cinematography. Filmed speech sequences last on average max. 2–5 minutes, and to avoid background noises during this time the blower should be turned off. This is possible with the material just described, as soon as a predetermined air pressure has built up in the sack. The air pressure in the sack and thus the state of inflation of the sack are preferably monitored by a pressure sensor disposed inside the sack or on its outer surface.

The light transmittance or transparency of the light-sack material can vary, depending on the intended use; in particular, it depends on the degree and/or the nature of the tinting of the material. Preferably the light-sack material is extremely transparent.

The transparency should be as uniform as possible over the entire surface of the light sack; that is, preferably the light sack is coloured white approximately uniformly over its entire surface. However, it can also be provided with various patterns and/or colours in order to achieve special lighting effects. This can be advantageous primarily when one or more light sacks are themselves intended to serve as decoration, for instance when they form part of a stage set.

As mentioned above, in order to inflate the sack to a predetermined shape a blower device is provided, connected to the spotlight and/or to a sack-holding apparatus and/or is at least partially integrated therewith. The spotlight or a connecting element between spotlight and light sack, which is advantageously constructed as a sack-holding apparatus, can for example comprise inlet and outlet openings and associated tubes that can be connected to a blower in order to conduct an airstream for inflating the sack.

The means for connecting spotlight and sack in one preferred embodiment is a sack-holding apparatus connected to the spotlight and/or integrated therein, with which spotlight and sack can be connected. The holding apparatus is preferably detachably connected to the spotlight; however, it can also be an integral component of the spotlight. The holding apparatus comprises input and output tubes that can be connected to a blower in order to inflate the sack.

The holding apparatus can be connected to the spotlight by detachable devices, e.g. a snap closure, (rotatable) catch closure, screw threading or the like. If the means for attaching the light sack is integrated into the spotlight, it can take the form for example of a ridge running around the outer circumference of the spotlight parallel to its edge and set somewhat back therefrom, over which the light sack is pulled and behind which a band is positioned to hold the light sack in place.

BRIEF DESCRIPTION OF THE DRAWINGS

In the following, preferred embodiments of a lighting device in accordance with the invention are explained with reference to the attached drawings, wherein.

Figure 1:
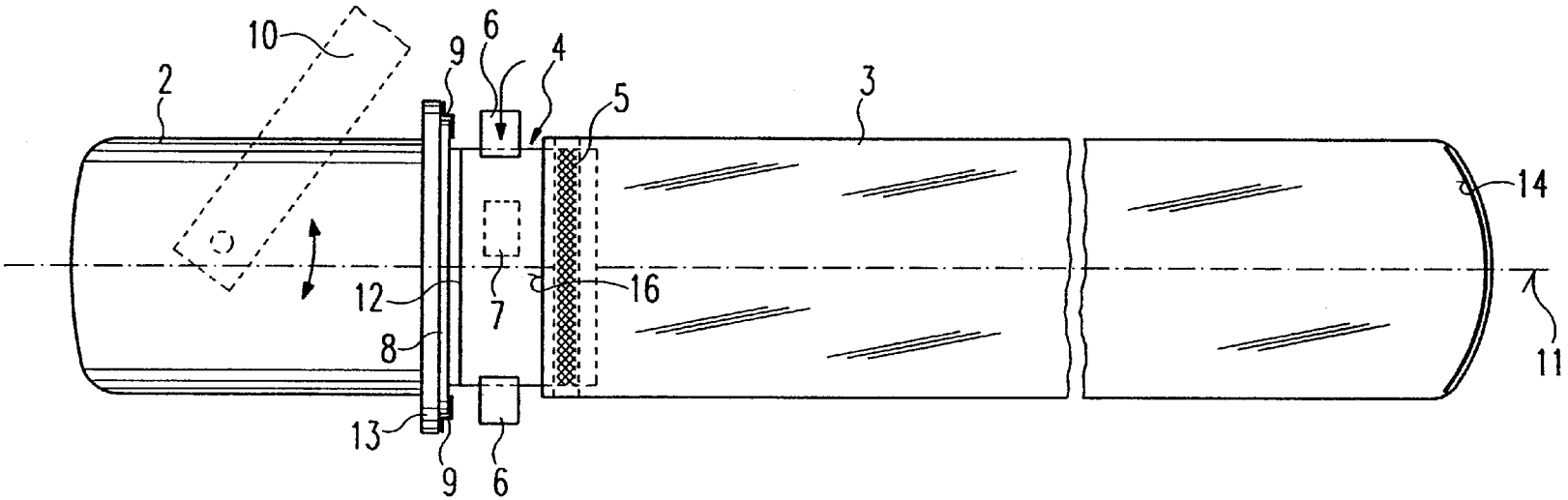
FIG. 1 shows a first embodiment of a lighting device in accordance with the invention, in schematic longitudinal section.

The lighting device 1 according to FIG. 1 comprises a spotlight 2, a sack 3 and a holding apparatus 4 disposed between spotlight and sack, which is detachably connected to the spotlight 2 and to which the sack 3 is fixed by way of a retaining band 5. The retaining band 5 is positioned around the outer circumference of the cylindrical holding apparatus in the vicinity of the end towards the sack. The holding apparatus 4 comprises gas-supply-tubes 6 connectable to a blower to lead air of the blower into the interior of the sack. At the end of the holding apparatus towards the spotlight is disposed a gasket 12 made of a transparent and heat-resistant material. In particular, it is made of a foil material. This gasket 12 is intended to prevent a rapid decay of the pressure built up by the air from the blower in the space within the sack 3 and holding apparatus 4. The holding apparatus is connected to the spotlight 2 by way of a flange-like shoulder 8, over which retaining clips 9 rotatably attached to the spotlight can be swivelled. The spotlight is pivotably attached to the spotlight mounting 10 indicated by the dashed outline. As mentioned previously, in the embodiment shown here the sack has the shape of a cylindrical rod. The long axis 11 coincides with the long axis of the holding apparatus 4 and that of the spotlight 2. In particular, the long axis 11 coincides with the optical axis of the spotlight 2. The gasket 12 preferably, as mentioned above, consists of a transparent, heat resistant glass or a foil. At the inner circumference of the holding apparatus a pressure-relief valve 7 can be provided, which can turn the blower down or all the way off in order to avoid excess pressure.

The insert holder 13 formed at the front side of the spotlight 2 serves to receive colour filters, diaphragms, shutters, an additional lens or the like, such as are customarily used in connection with spotlights of this kind to produce specific effects.

Figure 2:
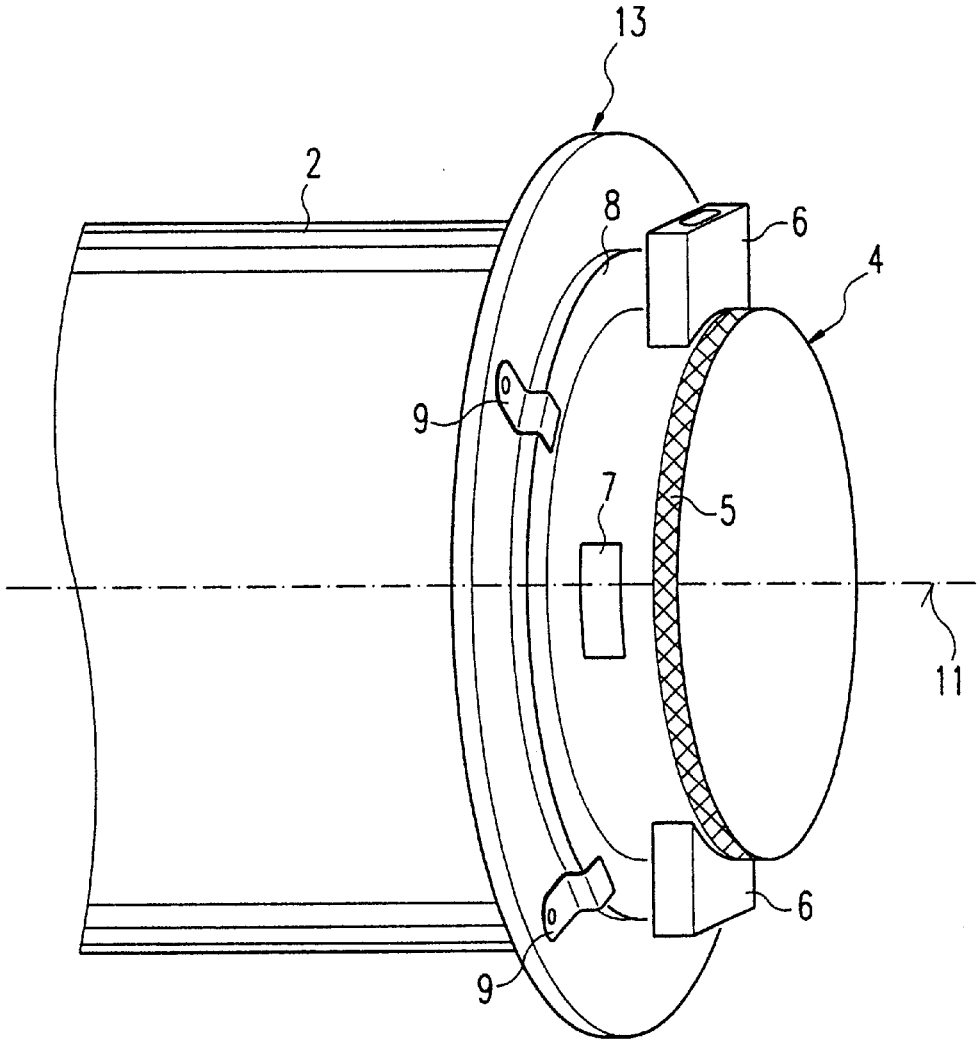
FIG. 2 shows part of the device according to FIG. 1, namely the holding apparatus for the "light sack" in perspective view.

FIG. 2 is a perspective drawing of a preferred holding apparatus 4 connected to the spotlight 2. The components are the same as shown in FIG. 1 and are identified by the same reference numerals, so that there is no need to describe them again.

It should also be pointed out that the sack on at least part of its inner surface comprises a light-reflecting zone, in particular on the end surface of the sack opposite the spotlight. In the embodiment shown here, the light-reflecting zone is formed by a reflecting film 14 disposed on the inner surface of the end wall of the sack 3. In this way the spotlight beam can be focussed, so that the distribution of light over the length of the tubular sack can be altered.

Finally, it should be pointed out that the retaining band 5 can be a Velcro or adhesive band that cooperates with a corresponding or complementary Velcro or adhesive band on the inner surface of the edge of the light sack 3 that faces the spotlight. The retaining band can also be designed as an external steel strap similar to a pipe clamp. The construction of the retaining band must be such that the light sack 3 is fixed to the holding apparatus 4 in a substantially airtight manner over its circumference.

Figure 3:
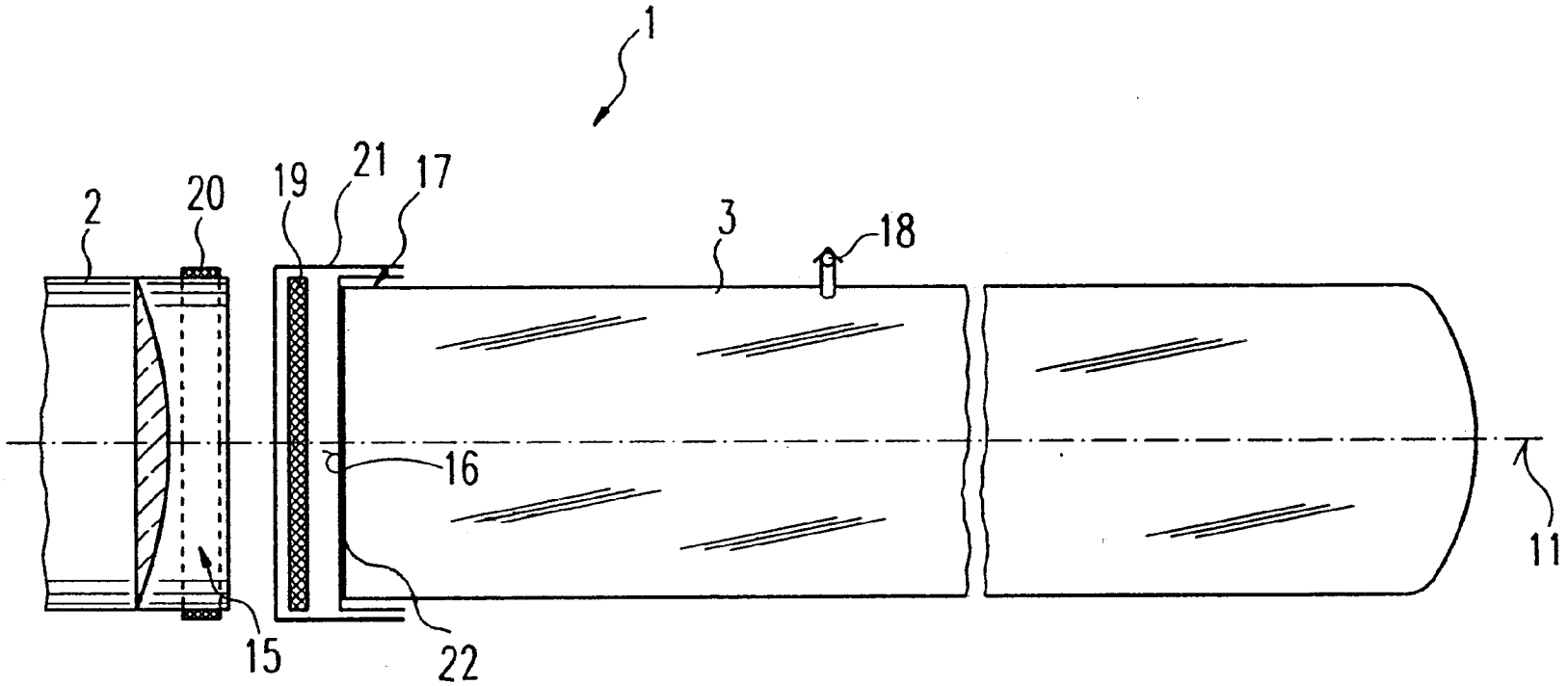
FIG. 3 shows a second embodiment of a lighting device constructed in accordance with the invention, in schematic side view.

The embodiment shown in FIG. 3 represents a lighting device that consists of a spotlight 2 and, detachably connected thereto, an inflatable sack made of an at least partially transparent material and comprising a highly transparent light entrance orifice 16 that can be positioned in relation to a light exit orifice 15 of the spotlight 2. The light entrance orifice 16 of the sack 3 is defined by a piece of transparent foil of a glass plate 22, which is connected in an airtight manner in that its circumferential edge is seated against the edge of a corresponding opening in the sack 3. In this embodiment the sack 3 is a unit closed on all sides, similar to an "air mattress". So that the sack can be inflated, of course, a valve 18 must be provided. This valve can also be used to let the air out of the sack after use.

To connect the sack 3 to the spotlight 2, at the light entrance side or more particularly around the light entrance orifice 16 a connector cylinder 21 is disposed, on the inner surface of which a retaining means in the form of a Velcro band 19 is provided. This cooperates with a complementary Velcro band 20 disposed on the outer circumference of the spotlight opening. To create the attachment the connector cylinder must be pushed over the complementary spotlight opening until the Velcro bands 19, 20 are superimposed. An external retaining strap can additionally be placed around the connector cylinder 21 in the region of the attachment site and tightened. In this respect the construction described here is arbitrarily variable. The important thing is only that the inflated air sack 3 can be detachably connected to the spotlight exit orifice in such a way that no light emerges laterally between air sack and spotlight exit orifice. That is, it should be guaranteed that all of the light passes through the transparent entrance orifice 16 into the air sack 3.

As was explained above, in the embodiment according to FIGS. 1 and 2 the blower for inflating the sack 3, in particular the air outlet from the blower that opens into the sack, is provided with a nonreturn valve, in particular a flap under elastic tension in the closing direction, to prevent air from escaping from the sack 3 after the blower has been turned off. This embodiment is of special significance for original-soundtrack cinematography. It ensures that the sack will remain sufficiently inflated, so that its shape is stable, for up to 60 minutes with no input from the blower.

This problem does not arise in the embodiment according to FIG. 3; there the sack is inflated exclusively by way of the valve 18, which corresponds to an "air mattress" valve. Of course, the material of which the sack is made must be correspondingly airtight. The same applies to the transparent cover over the light entrance orifice 16.

The holding apparatus 4 in cross section can be either circular or have the shape of a 6- or 8-sided polygon. The last of these shapes is particularly simple to manufacture. Furthermore, with this embodiment it is also possible to achieve a tight seal between the circumferential edge of the air sack 3 and the circumferential edge of the holding apparatus 4, even when the circumferential edge of the air sack 3 is circular. Care should be taken to ensure that the circumferential lengths of air sack and holding apparatus are the same.

All the characteristics disclosed in the application documents are claimed as essential to the invention insofar as they are new to the state of the art individually or in combination.

LIST OF REFERENCE NUMERALS

1 Lighting device
2 Spotlight
3 Sack
4 Holding apparatus
5 Retaining band
6 Air- or gas-supply tubes
7 Pressure sensor
8 Ring flange
9 Retaining clip
10 Spotlight mounting
11 Long axis
12 Gasket
13 Insert holder
14 Reflecting foil
15 Light exit orifice
16 Light entrance orifice
17 Circumferential edge
18 Valve
19 Retaining means
20 Complementary retaining means
21 Connector cylinder

What is claimed is:

1. A lighting device, comprising:

a cinematographic or stage spotlight; and an inflatable sack detachably connected to the spotlight and made of a material that is at least partially light-transmitting, wherein the sack comprises a transparent light entrance orifice to couple to a light exit orifice of the spotlight, wherein the light entrance orifice of the inflatable sack is defined by a transparent glass disk or a transparent foil, which along a circumferential edge is connected in an airtight manner to an edge of a corresponding orifice in the sack.

2. The lighting device of claim 1, wherein the sack is closed so as to be airtight on all sides, and wherein the sack comprises a valve through which the sack can be inflated or, after use, deflated.

3. The lighting device of claim 1, wherein the sack in a region of the light entrance orifice comprises a connector to connect the sack to the light exit orifice of the spotlight, wherein the connector corresponds to a complementary connector on the spotlight.

4. The lighting device of claim 1, wherein the sack is open at a light entrance side, wherein the sack is inflatable through a corresponding opening through an external blower attached to the spotlight.

5. The lighting device of claim 4, further comprising a sack-holding apparatus that connects the spotlight and the sack, wherein the sack holding device comprises air-or gas-supply tubes that are connectable to the blower to inflate the sack.

6. The lighting device of claim 5, wherein the sack-holding apparatus is detachably connected to the spotlight.

7. The lighting device of claim 6, further comprising a cylindrical holding apparatus that is detachably connected to the spotlight, wherein the cylindrical holding apparatus comprises gas inlets connectable to the blower, a ring flange that projects radially outward and is connectable to the spotlight by retaining clips, a gasket made of a transparent and heat-resistant material to seal off a space delimited by the cylindrical holding apparatus and the sack, and to which the sack is connectable in a substantially airtight manner by way of a retaining band.

8. The lighting device of claim 7, wherein the retaining band is a Velcro band or adhesive band.

9. The lighting device of claim 1, further comprising a sack-holding apparatus connected to the spotlight, the sack-holding apparatus providing for detachably connecting the spotlight and the sack.

10. The lighting device of claim 9, wherein a blower device to inflate the sack to a predetermined shape is connected to at least one of the spotlight and the sack-holding apparatus.

11. The lighting device of claim 1, wherein the sack in an inflated state has substantially a shape selected from a group consisting of a cylindrical rod, a sphere, a hemisphere, a cone and a truncated cone.

12. The lighting device of claim 1, wherein the sack is made of a woven textile or an airtight plastic film.

13. The lighting device of claim 1, wherein the sack comprises a light-reflecting zone on at least part of an inner surface.

14. The lighting device of claim 13, wherein the light-reflecting zone is located a side of the sack opposite an orifice through which light enters from the spotlight.

15. The lighting device of claim 1, wherein, to determine whether an air pressure inside the sack is at a predetermined level, a pressure sensor is connected to a blower so that after a predetermined pressure in the sack has been reached, the blower is turned down or switched off.

16. The lighting device of claim 1, wherein a blower to inflate the sack has a nonreturn valve in order to prevent air from escaping out of the sack through the blower when the blower is turned off.

17. The lighting device of claim 16, wherein an air outlet of the blower comprises the nonreturn valve.

18. The lighting device of claim 16, wherein the nonreturn valve is a valve flap under elastic tension in a closing direction.

* * * * *